US010728970B2

(12) United States Patent
Shao

(10) Patent No.: US 10,728,970 B2
(45) Date of Patent: Jul. 28, 2020

(54) DRIVING CIRCUIT APPARATUS FOR AUTOMATICALLY DETECTING OPTIMIZED DRIVING VOLTAGE OF LIGHT STRING

(71) Applicant: BLOOMING INTERNATIONAL LIMITED, British West Indies (AI)

(72) Inventor: Shu-Fa Shao, Taipei (TW)

(73) Assignee: Blooming International Limited, British West Indies (AI)

( * ) Notice: Subject to any disclaimer, the term of this patent is extended or adjusted under 35 U.S.C. 154(b) by 0 days.

(21) Appl. No.: 16/397,419

(22) Filed: Apr. 29, 2019

(65) Prior Publication Data

US 2019/0335559 A1 Oct. 31, 2019

Related U.S. Application Data

(60) Provisional application No. 62/693,802, filed on Jul. 3, 2018.

(51) Int. Cl.
*H05B 45/10* (2020.01)
*H05B 45/44* (2020.01)

(52) U.S. Cl.
CPC ..... *H05B 45/10* (2020.01); *H05B 45/44* (2020.01)

(58) Field of Classification Search
CPC ..... H05B 33/0851; H05B 33/0824
See application file for complete search history.

(56) References Cited

U.S. PATENT DOCUMENTS 5,150,964 A 9/1992 Tsui
5,747,940 A 5/1998 Openiano
(Continued)

FOREIGN PATENT DOCUMENTS

CA 2 655 486 A1 9/2009
CN 200982547 Y 11/2007
(Continued)

OTHER PUBLICATIONS

Analog Optical Isolators VACTROLS; http://denethor.wlu.ca/pc300/optoisolators/analogoptoisolatorintroduction.pdf; Nov. 26, 2003 (Year: 2003).*

*Primary Examiner* — Renan Luque
(74) *Attorney, Agent, or Firm* — Christensen, Fonder, Dardi & Herbert PLLC

(57) ABSTRACT

A driving circuit apparatus, including: a power converter, a reference light source, a light shield member, a luminance detection element, a comparison circuit, and a controller. The power converter outputs a driving voltage to drive a light string to emit light. The driving voltage continuously increases toward a maximum value. One end of the reference light source is electrically connected to the light string, and the other end is electrically grounded. The light shield member has an opaque chamber, and the reference light source and luminance detection element are disposed in the chamber. The comparison circuit receives a luminance signal from the detection element and determines whether the luminance signal strength is greater than a reference signal strength. When the luminance signal strength is greater than the reference signal strength, the controller sends an interrupt signal to the power converter to set an output value of the driving voltage.

22 Claims, 4 Drawing Sheets

(56) References Cited

U.S. PATENT DOCUMENTS

| | | | | |
|---|---|---|---|---|
| 5,884,125 | A * | 3/1999 | Taniguchi | G03G 15/047 399/128 |
| 6,086,222 | A | 7/2000 | Juba | |
| 6,450,665 | B1 | 9/2002 | Cheng | |
| 7,131,748 | B2 | 11/2006 | Kazar et al. | |
| 7,160,140 | B1 | 1/2007 | Mrakovich et al. | |
| 7,481,555 | B2 | 1/2009 | Huang et al. | |
| 7,569,996 | B2 | 8/2009 | Holmes | |
| 7,926,978 | B2 | 4/2011 | Tsai | |
| 7,976,191 | B2 | 7/2011 | Gibboney | |
| 8,076,872 | B2 | 12/2011 | Sauerlander | |
| 8,203,275 | B2 | 6/2012 | Ruxton | |
| 8,397,381 | B2 | 3/2013 | Tsai | |
| 9,291,318 | B1 | 3/2016 | Benson | |
| 9,386,652 | B1 * | 7/2016 | Lee | H05B 33/0851 |
| 9,468,062 | B2 | 10/2016 | Rybicki | |
| 9,763,298 | B2 | 3/2017 | Yu | |
| 9,617,074 | B2 | 4/2017 | Hellenbrand | |
| 9,939,117 | B1 | 4/2018 | Peng | |
| 10,205,073 | B2 | 2/2019 | Altamura | |
| 2002/0027778 | A1 | 3/2002 | Ko | |
| 2003/0063463 | A1 | 4/2003 | Sloan et al. | |
| 2004/0246718 | A1 | 12/2004 | Fan | |
| 2006/0221609 | A1 | 10/2006 | Ryan, Jr. | |
| 2007/0262725 | A1 | 11/2007 | Koren | |
| 2008/0094828 | A1 | 4/2008 | Shao | |
| 2009/0302771 | A1 | 12/2009 | Peng | |
| 2010/0141161 | A1 | 6/2010 | Hering et al. | |
| 2010/0157598 | A1 | 6/2010 | Tsai | |
| 2011/0228535 | A1 | 9/2011 | Shao | |
| 2011/0310601 | A1 | 12/2011 | Shao | |
| 2011/0316442 | A1 * | 12/2011 | Sako | H05B 45/37 315/291 |
| 2012/0007510 | A1 * | 1/2012 | Horng | H05B 33/0818 315/149 |
| 2013/0140993 | A1 * | 6/2013 | Buerrig | H05B 33/0887 315/134 |
| 2013/0181232 | A1 * | 7/2013 | Jeromerajan | H01L 31/0203 257/81 |
| 2013/0249417 | A1 | 9/2013 | Verlinden | |
| 2014/0055439 | A1 * | 2/2014 | Lee | H05B 37/036 345/212 |
| 2015/0008835 | A1 | 1/2015 | Sugiura et al. | |
| 2015/0373800 | A1 * | 12/2015 | Cao | G02F 1/133603 349/69 |
| 2016/0338171 | A1 * | 11/2016 | Bhagat | H05B 33/0845 |
| 2016/0341408 | A1 | 11/2016 | Altamura | |
| 2017/0023223 | A1 | 1/2017 | Tsai | |
| 2017/0108185 | A1 | 4/2017 | He | |
| 2018/0110101 | A1 | 4/2018 | Kottritsch | |
| 2018/0231226 | A1 | 8/2018 | Koo | |
| 2019/0234597 | A1 | 8/2019 | Zhu | |
| 2019/0277458 | A1 | 9/2019 | Shao | |
| 2019/0335559 | A1 | 10/2019 | Shao | |

FOREIGN PATENT DOCUMENTS

| | | | |
|---|---|---|---|
| CN | 201121811 | Y | 9/2008 |
| CN | 201897194 | U | 7/2011 |
| CN | 201898147 | U | 7/2011 |
| CN | 201966240 | U | 9/2011 |
| CN | 202613183 | U | 12/2012 |
| CN | 203703878 | U | 7/2014 |
| EP | 1 172 602 | A1 | 1/2002 |
| GB | 2 454 546 | A | 5/2009 |

* cited by examiner

DRIVING CIRCUIT APPARATUS FOR AUTOMATICALLY DETECTING OPTIMIZED DRIVING VOLTAGE OF LIGHT STRING

PRIORITY CLAIM

The present application claims the benefit of U.S. Provisional Application No. 62/693,802, filed Jul. 3, 2018, and also claims priority to Chinese Patent Application No. 201810390038.2, filed Apr. 27, 2018, both of which are incorporated herein by reference in their entireties.

FIELD OF THE INVENTION

The present invention relates to a driving circuit for a light string, and in particular, to a driving circuit apparatus for automatically detecting an optimized driving voltage of a light string.

BACKGROUND OF THE INVENTION

A light string is a string-shaped illumination device having a plurality of light sources (for example, light emitting diodes or small-sized bulbs) through serial connection, parallel connection or hybrid connection of serial/parallel connection. The number of light sources in the light string affects the optimized driving voltage of the light string. Taking a serial connection light string as an example, if all light sources need to reach a same luminance, a long light string needs a relatively large driving voltage, and a short light string needs a relatively small driving voltage. Therefore, an optimized driving circuit needs to be matched with the design of the light string, so that all light sources can reach a maximum luminance allowed by the specification (a maximum current that can be received), without burning out or failing.

When a light string device is assembled in a factory or a consumer replaces a light string of the light string illumination device, a correct model of light string corresponding to the driving circuit is required. Otherwise, the driving voltage may be excessively small to cause an insufficient luminance, or the driving voltage may be excessively large to cause the light string to burn out. For a manufacturer or a vendor, the need for multiple driving circuit models creates an inventory and stock management challenge.

Currently there are driving circuits that can change the output voltage. A user or an assembler has to switch the output voltages of these known driving circuits correctly by using a switch. If the output voltage is set incorrectly, for example, too high, the light string quickly burns out after being powered on.

SUMMARY OF THE INVENTION

Known light string driving circuits need to be selected in cooperation with the specification of the light string, often causing the problem that the light string easily has an insufficient luminance or that it easily burns out.

To resolve the foregoing problem, the present invention provides a driving circuit apparatus for automatically detecting an optimized driving voltage of a light string. The driving circuit apparatus is used to output a driving voltage to drive a light string to emit light, and automatically detect a value of the driving voltage needed to make a plurality of light sources of the light string reach a predetermined luminance. In an embodiment, the driving circuit apparatus includes: a power converter, a reference light source, a light shield member, a luminance detection element, a comparison circuit, and a controller.

The power converter is used for outputting the driving voltage, wherein the driving voltage continuously increases to a maximum value from an initial value, and the driving voltage is stopped from increasing, based on an interrupt signal, to fix the value of the driving voltage. One end of the reference light source is electrically connected to the light string, and the other end is electrically grounded. The light shield member has an opaque chamber, where the reference light source is disposed in the chamber. The luminance detection element is disposed in the chamber, and used for detecting a luminance of a light sent by the reference light source and feeding back a luminance signal related to the luminance of the light. The comparison circuit is configured to receive the luminance signal, determine whether the strength of the luminance signal is greater than a strength of a reference signal, and to output a comparison result. The controller is electrically connected to the power converter and the comparison circuit, and is configured to send an interrupt signal to the power converter when the strength of the luminance signal is greater than the strength of the reference signal, to make the power converter fix an output value of the driving voltage.

According to the foregoing driving circuit apparatus, the problem with the light string having an insufficient luminance or burning out when the specification of the light string is changed because the driving voltage in the prior art is a fixed output, may be avoided.

In an embodiment, the reference light source is of a specification the same as that of each light source of the light string.

In an embodiment, the light shield member is an opaque tube, the reference light source is disposed at one end of the tube, and the luminance detection element is disposed at the other end of the tube.

In an embodiment, when the driving circuit apparatus starts, the controller sends an initial signal to the power converter, to start the power converter to begin to output the driving voltage, and to continuously increase the driving voltage to the maximum value from the initial value.

In an embodiment, the luminance detection element is a photoresistor, and one end of the photoresistor receives a standard voltage while the other end of the photoresistor is electrically grounded through a grounding resistor. A resistance value of the photoresistor decreases along with the luminance, and the luminance signal is a voltage of a node between the luminance detection element and the grounding resistor while the reference signal is a reference voltage.

In an embodiment, the comparison circuit includes a comparator, used for comparing a voltage of the luminance signal with the reference voltage, and outputting a high-level signal when the voltage of the luminance signal is greater than the reference voltage, to trigger the controller to send the interrupt signal.

In an embodiment, the driving circuit apparatus further includes an auxiliary comparator, connected to the comparator in parallel. The auxiliary comparator receives the luminance signal, and determines whether the strength of the luminance signal is greater than the strength of an upper limit signal, and to output a warning result if necessary. When the strength of the luminance signal is greater than the strength of the upper limit signal, the controller again controls the power converter to increase the driving voltage to the maximum value from the initial value and receives a comparison result of the comparator.

In an embodiment, the driving circuit apparatus further includes a switch element, wherein the reference light source receives the driving voltage through the switch element, and the controller continuously outputs a switching signal, so that the switch element rapidly switches between switch-on and switch-off.

In an embodiment, the driving circuit apparatus further includes a memory unit. Each time the driving circuit apparatus starts, the controller checks whether the memory unit has stored the output value of the driving voltage. If stored, the controller controls, by using the stored output value of the driving voltage stored in the memory unit, the power converter to output the driving voltage by using the stored output value, and does not detect the driving voltage anymore. If not stored, the controller controls the power converter to increase the driving voltage to the maximum value from the initial value, and receives a comparison result of the comparator.

In an embodiment, the driving circuit apparatus further includes a reset switch, electrically connected to the controller, and used for resetting the memory unit, so that the controller again controls the power converter to increase the driving voltage to the maximum value from the initial value, and receives the comparison result of the comparator.

According to embodiments of the driving circuit apparatus of the present invention, when replacing or installing the light string, the user does not need to understand a difference between specifications of different light strings, and may directly connect the light string to the driving circuit apparatus. The driving circuit apparatus is configured to automatically detect a driving voltage that is needed for driving the light string to reach a maximum luminance but that does not burn out the light string, and to continuously drive the light string to emit light at the driving voltage. Moreover, in one or more embodiments of the present invention, the controller may periodically, after being reset, or according to real-time detection, restart the procedure for detecting the driving voltage, so that a value of the driving voltage may change in cooperation with a change of an actual situation of the light string, to obtain an optimized driving voltage.

BRIEF DESCRIPTION OF THE DRAWINGS

The present invention will become more fully understood from the detailed description given herein below for illustration only, and thus are not intended to limit the present invention, and wherein.

DETAILED DESCRIPTION

Figure 1:
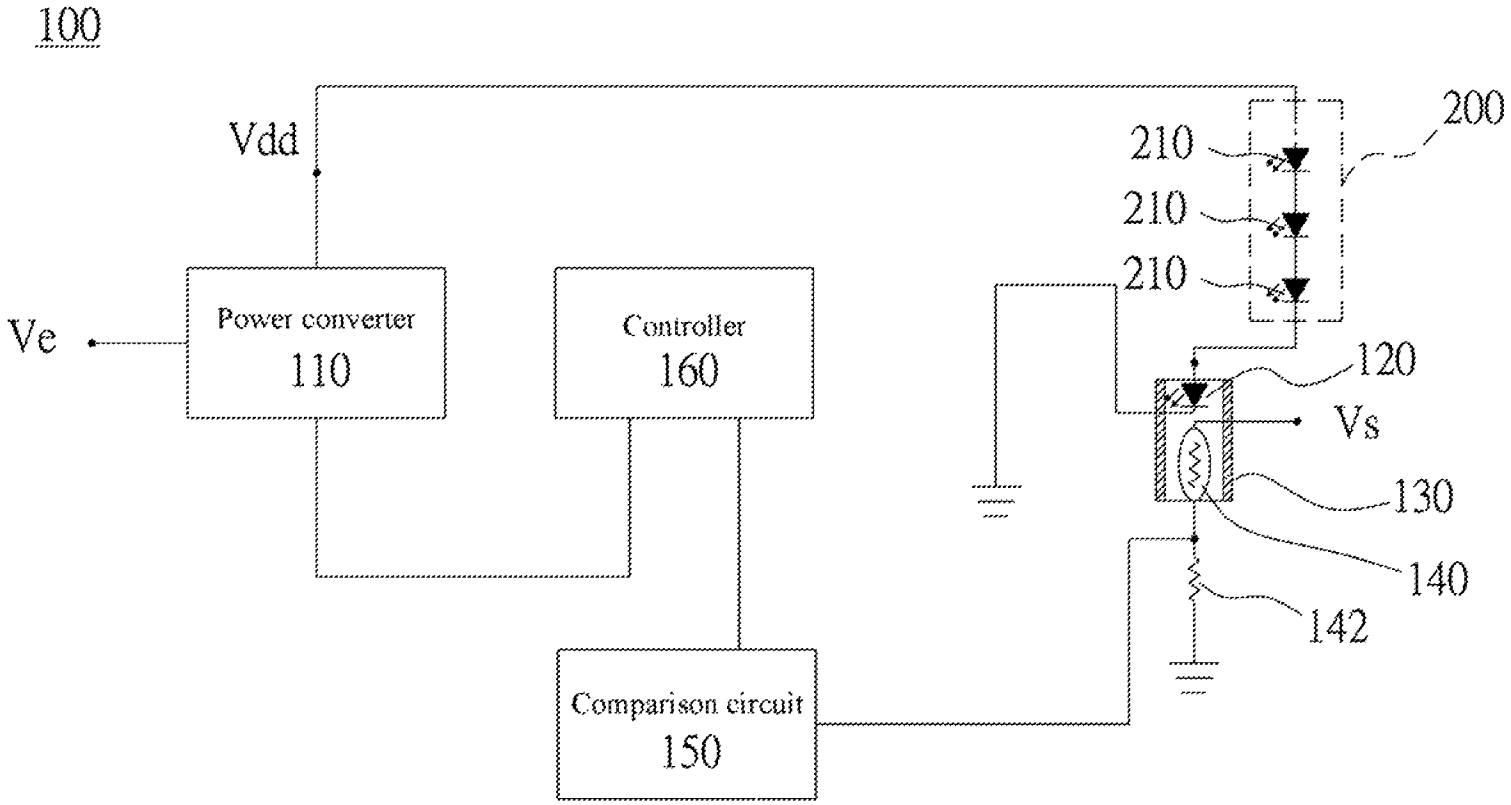
FIG. 1 is a circuit block diagram according to a first embodiment of the present invention.

Referring to FIG. 1, a driving circuit apparatus 100 for automatically detecting an optimized driving voltage Vdd of a light string disclosed in a first embodiment of the present invention. The driving circuit apparatus 100 is configured to automatically detect a voltage value of a driving voltage Vdd required to make a plurality of light sources 210 of a light string 200 reach a predetermined luminance, thereby automatically switching or controlling the output driving voltage Vdd. The driving circuit apparatus 100 configured to automatically detect an optimized driving voltage Vdd of a light string includes a power converter 110, a reference light source 120, a light shield member 130, a luminance detection element 140, a comparison circuit 150, and a controller 160.

As shown in FIG. 1, the power converter 110 is used for receiving an external power source Ve, and converting the external power source into a driving voltage Vdd. The power converter 110 changes the output value of the driving voltage Vdd according to a control signal or automatically, so that the driving voltage Vdd continuously increases toward a maximum value from an initial value, and the driving voltage Vdd may be stopped from increasing according to an interrupt signal, to thereby fix or set the value of the driving voltage Vdd. One end of the light string 200 is electrically connected to the power converter 110 through a power output port, to receive the driving voltage Vdd. In an embodiment, power converter 110 for driving the light string 200, or multiple light strings 200, outputs a driving voltage Vdd that may range from 0 V to 29 V.

The light string 200 may have a plurality of light sources 210 all in serial connection, all in parallel connection, or a hybrid of serial/parallel connections, such as multiple groups of light sources 210, each light source 210 of a group in parallel with one another, with the groups connected in serial. The light source 210 may be a light emitting diode (LED) or another lamp, such as a small-sized incandescent bulb. The power output port may be a socket or similar functioning connector. In an embodiment, a plug is disposed at an input end of the light string 200, and the plug may be rapidly plugged in or unplugged from the socket, so as to facilitate connection or removal of the light string 200.

As depicted in FIG. 1, one end of the reference light source 120 is electrically connected to the light string 200, the other end is electrically grounded. The light string 200 and the reference light source 120 form a complete circuit loop from an output end of the driving voltage Vdd to ground. Both the light string 200 and the reference light source 120 are driven by the driving voltage Vdd to emit light, and the luminance of the reference light source 120 changes along with the resistance value of the light string 200. Generally, the reference light source 120 may be of a specification the same as that of the light source 210 of the light string 200, so as to facilitate setting of a comparison condition of the comparison circuit 150. For example, light source 210 may comprise an LED having a 3 VDC nominal rating, and reference light source 120 also comprising a 3 VDC LED.

In an embodiment, the light shield member 130 comprises an opaque chamber, and the reference light source 120 is disposed in the chamber of the light shield member 130, so that light emitted by the reference light source 120 is not leaked, or does not emit outside the chamber. In an embodiment, the light shield member 130 may comprise an opaque tube (for example, a black tube), the reference light source 120 is disposed at an opening of one end; the reference light source 120 is secured in place, and the opening is sealed by using an opaque material.

The luminance detection element 140 may be a combination of a photoresistor and a necessary circuit, or may be another photoelectric element that can detect the value of the luminance. The luminance detection element 140 is also disposed in the chamber of the light shield member 130, so that the luminance detection element 140 does not detect, or is affected by, external light. The luminance detection element 140 detects a luminance of a light sent by the reference light source 120, and feeds back a luminance signal related to the strength of the light. The form of the luminance signal is determined according to the configuration of the luminance detection element 140. In an embodiment, when the light shield member 130 is an opaque tube, the luminance detection element 140 is disposed at an opening of the other end of the chamber, the luminance detection element 140 is fixed and the opening is sealed by using an opaque material.

The comparison circuit 150 is connected to the luminance detection element 140, is used for receiving the luminance signal, and determining whether the strength of the luminance signal is greater than a strength of a reference signal, and to output a comparison result.

The controller 160 is electrically connected to the comparison circuit 150 and the power converter 110. When the driving circuit apparatus 100 starts, the controller 160 may send an initial signal to the power converter 110 to start the power converter 110 to begin to output the driving voltage Vdd, and continuously increase the driving voltage Vdd toward a maximum value from the initial value. The controller 160 continuously receives a comparison result of the comparison circuit, and sends an interrupt signal to the power converter 110 when the strength of the luminance signal is greater than the strength of the reference signal, to make the power converter 110 set an output value of the driving voltage Vdd.

As shown in FIG. 1, when the light string 200 is connected to the driving circuit apparatus 100, and the driving circuit apparatus 100 is started, both the light string 200 and the reference light source 120 are driven by the driving voltage Vdd to emit light, and the luminance gradually increases as the driving voltage Vdd increases. When all the light sources 210 of the light string 200 are disposed in serial connection, the reference light source 120 has a luminance the same as that of each light source 210 of the light string 200. When the light sources 210 of the light string 200 are in a hybrid connection of serial connection and parallel connection, a proportional relationship between the luminance of the reference light source 120 and the luminance of each light source 210 of the light string 200 exists. Therefore, the luminance of each light source 210 of the light string 200 may be obtained through the luminance of the reference light source 120.

In this case, the luminance detection element 140 may detect the luminance of the reference light source 120, and determine, through comparison, whether the strength of the luminance signal is greater than the strength of the reference signal, and output a comparison result. The strength of this reference signal is a strength that corresponds to an optimized luminance of each light source 210 of the light string 200, and that does not cause each light source 210 of the light string 200 to potentially burn out or fail because the driving voltage Vdd is excessively high. If the strength of the luminance signal is not greater than the strength of the reference signal, it indicates that the luminance of the light source 210 is still insufficient. If the strength of the luminance signal is greater than the strength of the reference signal, the luminance of the light source 210 has reached the optimized luminance, and if the driving voltage Vdd further increases, the light source 210 will likely burn out. In this case, the controller 160 may send an interrupt signal to the power converter 110 based on the comparison result, so that the power converter 110 stops increasing the driving voltage Vdd, and fixes the value of the driving voltage Vdd at an optimal voltage to drive the light string 200.

According to the foregoing driving circuit apparatus 100, the problems of the light string having an insufficient luminance or burning out when the specification of the light string 200 because the driving voltage Vdd in the art is limited to a fixed output voltage is thusly avoided. The driving circuit apparatus 100 may automatically detect the optimized driving voltage Vdd, so that the light string 200 may reach the maximum luminance, without driving the voltage excessively high and causing the light sources 210 to burn out.

Figure 2:
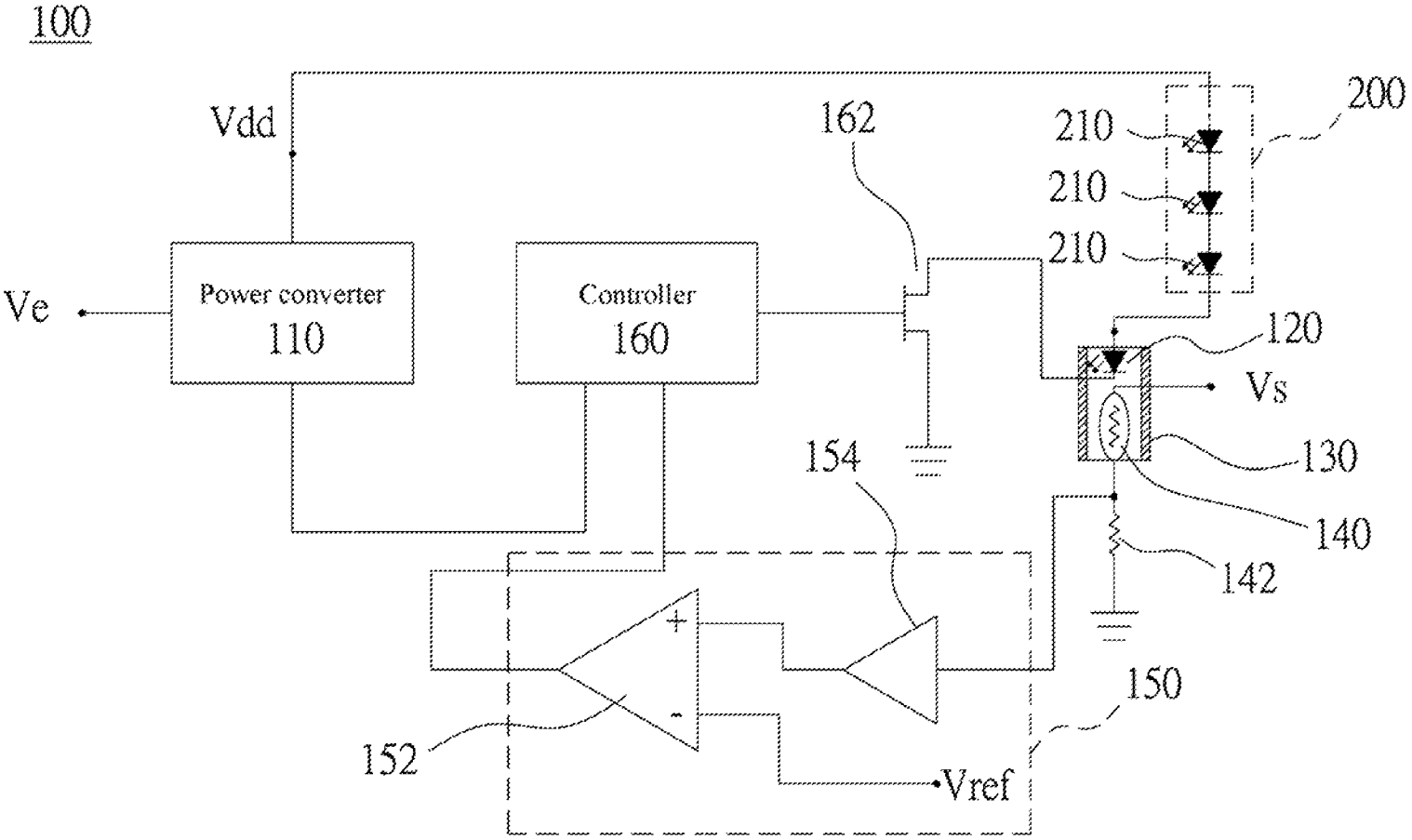
FIG. 2 is a circuit diagram according to a second embodiment of the present invention.

FIG. 2 depicts a driving circuit apparatus 100 for automatically detecting an optimized driving voltage Vdd of a light string disclosed in a second embodiment of the present invention. The driving circuit apparatus 100 is used for automatically detecting a value of a driving voltage Vdd needed to make a plurality of light sources 210 of a light string 200 reach a predetermined luminance, thereby automatically switching the output driving voltage Vdd. The driving circuit apparatus 100 for automatically detecting an optimized driving voltage Vdd of a light string includes a power converter 110, a reference light source 120, a light shield member 130, a luminance detection element 140, a comparison circuit 150, and a controller 160. The power converter 110, the reference light source 120, the light shield member 130, and the controller 160 are approximately the same as those in the first embodiment. Consequently, redundant details are not described below again, and details of only the luminance detection element 140 and the comparison circuit 150 are described below.

In an embodiment, the luminance detection element 140 is a photoresistor; one end of the luminance detection element 140 receives a standard voltage Vs, and the other end of the luminance detection element 140 is electrically grounded through a grounding resistor 142. A resistance value of the photoresistor may decrease along with the luminance, and a voltage of a node between the luminance detection element 140 and the grounding resistor 142 is changed, so as to be used as a luminance signal.

The comparison circuit 150 includes a comparator 152, used for receiving the luminance signal, and comparing the luminance signal with a reference signal. The reference signal is a reference voltage Vref. Both the reference voltage Vref and the standard voltage Vs may be fixed voltage outputs provided by the power converter 110. An amplifier 154 may be further disposed between the comparator 152 and the photoresistor, so as to amplify the luminance signal, thereby adjusting a proportional relationship between the luminance signal and the reference signal, so as to set an optimized luminance of the light string 200.

As the driving voltage Vdd increases, the luminance of the light source 210 gradually increases, and the resistance value of the photoresistor continuously decreases, so that a voltage value of the luminance signal continuously increases. When the voltage value of the luminance signal is less than the reference voltage Vref of the reference signal, it indicates that the luminance of the light string 200 has not reached the required luminance. In this case, the comparison result output by the comparator 152 maintains at a low-level signal, and the controller 160 performs no action. When the voltage value of the luminance signal is greater than the reference voltage Vref of the reference signal, it indicates that the luminance of the light string 200 has reached the required luminance. In this case, the comparison result output by the comparator 152 becomes a high level signal, and the controller 160 is triggered to send an interrupt signal, so that the power converter 110 stops increasing the driving voltage Vdd, and fixes the voltage value of the driving voltage Vdd to drive the light string 200.

Moreover, in an embodiment, the driving circuit apparatus 100 further includes a switch element 162, such as a transistor switch. The reference light source 120 is electrically grounded through the switch element 162. The controller 160 continuously outputs a switching signal, so that the switch element 162 rapidly switches between switch-on and switch-off. Therefore, in a detection process, the driving voltage Vdd can only transiently drive the light string 200 to be lighted, so as to prevent the light string 200 from being burned out in the detection process due to the initial value of the driving voltage being excessively high. Moreover, the continuously blinking light string 200 may also indicate to the user that the driving circuit apparatus 100 is detecting the value of a driving current.

Figure 3:
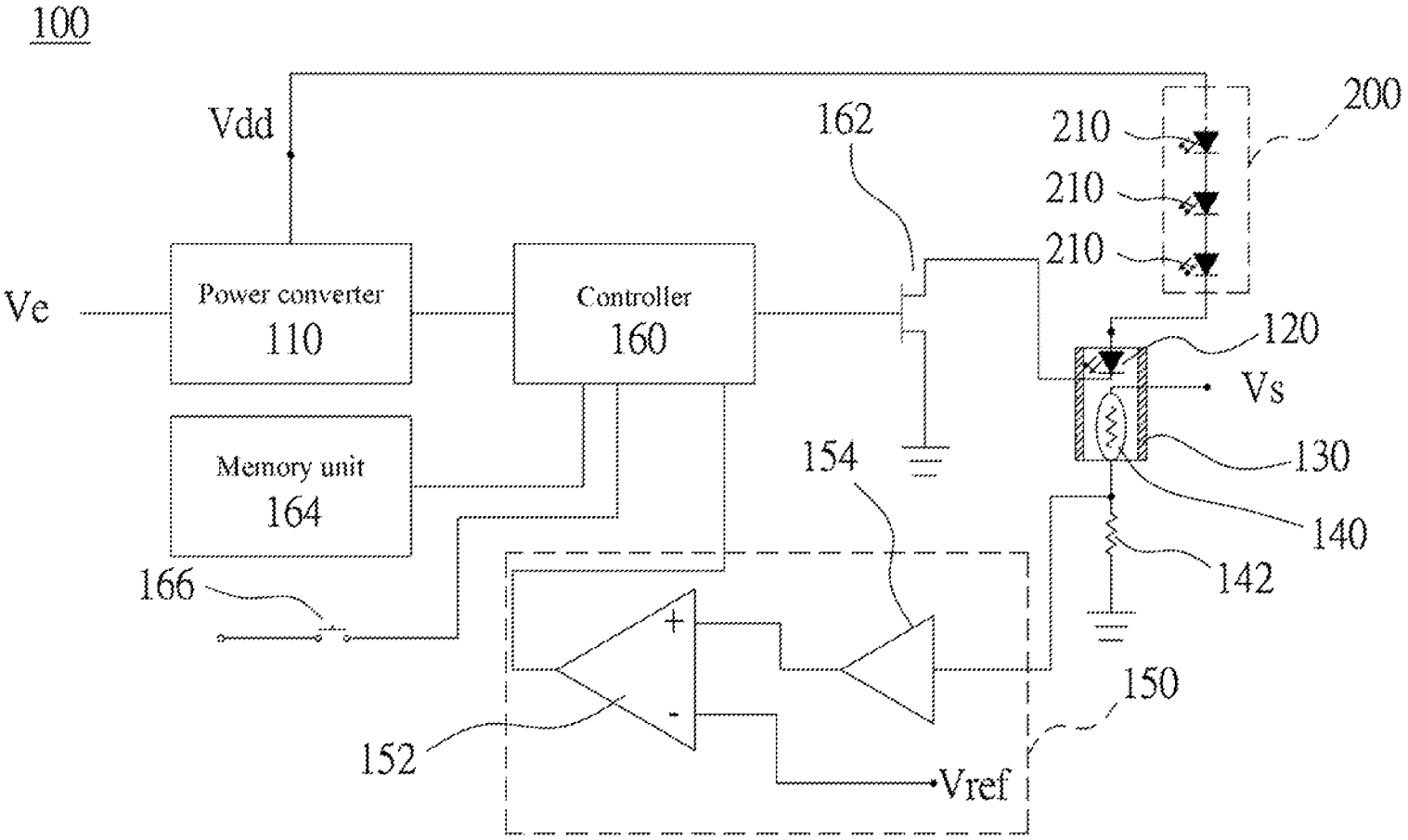
FIG. 3 is a circuit diagram according to a third embodiment of the present invention and FIG. 4 is a circuit diagram according to a fourth embodiment of the present invention.

FIG. 3 depicts a driving circuit apparatus 100 for automatically detecting an optimized driving voltage Vdd of a light string disclosed in a third embodiment of the present invention. The driving circuit apparatus 100 is used for automatically detecting a value of a driving voltage Vdd required to make a plurality of light sources 210 of a light string 200 reach a predetermined luminance, thereby automatically switching the output driving voltage Vdd. The driving circuit apparatus 100 for automatically detecting an optimized driving voltage Vdd of a light string includes a power converter 110, a reference light source 120, a light shield member 130, a luminance detection element 140, a comparison circuit 150, and a controller 160. Unlike the first and second embodiments, the driving circuit apparatus 100 in the third embodiment further includes a memory unit 164 and a reset switch 166.

In the third embodiment, the memory unit 164 is electrically connected to the controller 160. When the output value of the driving voltage Vdd is not stored in the memory unit 164, for example, the driving circuit apparatus 100 is used for the first time, and no output value of the driving voltage Vdd is preloaded in the memory unit 164. The controller 160 controls the power converter 110 to gradually increase the driving voltage Vdd to a maximum value from an initial value. The controller 160 outputs an interrupt signal according to a comparison result of the comparator 152, so that the power converter 110 stops increasing the driving voltage Vdd, and fixes the voltage value of the driving voltage Vdd to drive the light string 200. Moreover, the controller 160 obtains the value of the driving voltage Vdd from the power converter 110, and stores the value in the memory unit 164.

Each time the driving circuit apparatus 100 starts, the controller 160 first checks whether the memory unit 164 stores a value of the driving voltage Vdd. If a value is stored, the controller 160 controls, by using the output value of the driving voltage Vdd stored in the memory unit 164. The power converter 110 outputs the driving voltage Vdd by using the stored output value, and in an embodiment, does not detect the driving voltage Vdd anymore. If a value is not stored, the controller 160 controls the power converter 110 to increase the driving voltage Vdd to the maximum value from the initial value, and receives a comparison result of the comparator 152, thereby detecting the value of the optimized driving voltage Vdd.

The reset switch 166 is electrically connected to the controller 160, and used for resetting the memory unit 164. In an embodiment, and as depicted, the reset switch 166 may be user operated. The controller 160 again controls the power converter 110 to increase the driving voltage Vdd to the maximum value from the initial value, and receives the comparison result of the comparator 152, thereby detecting the value of the optimized driving voltage Vdd.

Certainly, in the foregoing embodiment, the luminance of the light source 210 of the light string 200 may decrease over time and with usage. Therefore, the controller 160 may again at a later time, be used to control, at a fixed time interval, the power converter 110 to gradually increase the driving voltage Vdd to the maximum value from the initial value, and receive the comparison result of the comparator 152, thereby detecting the value of the optimized driving voltage Vdd. In one such embodiment, the new value detected may be stored in memory.

Figure 4:
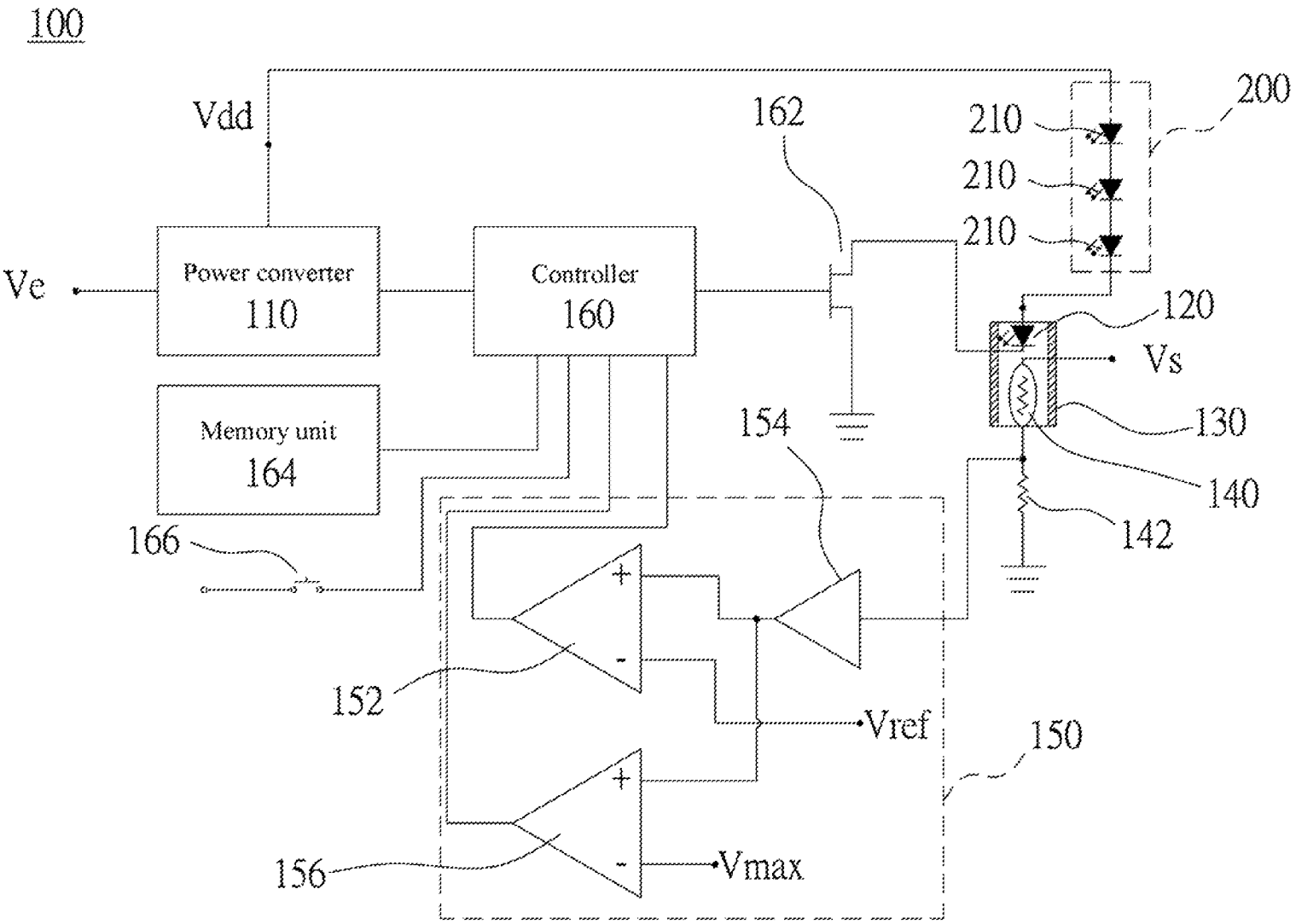

FIG. 4 depicts a driving circuit apparatus 100 for automatically detecting an optimized driving voltage Vdd of a light string disclosed according to a fourth embodiment of the present invention. The driving circuit apparatus 100 is used for automatically detecting an output value of a driving voltage Vdd required to make a plurality of light sources 210 of a light string 200 reach a predetermined luminance, thereby automatically switching the output value of the driving voltage Vdd. A difference between the fourth embodiment and the third embodiment is a different comparison circuit 150, and the comparison circuit 150 is described below.

When the output value of the driving voltage Vdd is stored in the memory unit 164, the controller 160 directly controls the power converter 110 to output the driving voltage Vdd at the stored value. However, in one exemplary use case, the light string 200 may be replaced with a new light string 200 having a lower resistance value, and the user may forget to press the reset switch 166 to restart detection of the appropriate driving voltage Vdd.

In the fourth embodiment, in addition to the original comparator 152, the comparison circuit 150 further includes an auxiliary comparator 156, disposed in parallel connection to the comparator 152. The auxiliary comparator 156 is likewise configured to receive the luminance signal, and determine whether the strength of the luminance signal is greater than the strength of an upper limit signal, and to output a warning that the strength of the upper limit signal is greater than strength of a reference signal. When the resistance value decreases because a part of the light string 200 is suddenly faulty (some of the light sources 210 are burned out), is cut off, is replaced, is changed in the connection manner, or the like, the luminance of the reference light source 120 increases (that is, the driving current increases). The reference signal is an upper limit voltage Vmax, and is greater than the reference voltage Vref. The upper limit voltage Vmax may be a fixed voltage output provided by the power converter 110. The auxiliary comparator 156 may directly receive the luminance signal, or may receive an amplified luminance signal through an amplifier 154, thereby adjusting a proportional relationship between the luminance signal and the reference signal. The upper limit voltage Vmax mainly corresponds to an upper limit of a luminance that can be sent by the light source 210 of the light string 200, that is, corresponds to a value of a maximum driving voltage Vdd that the light source 210 can bear.

When the power converter 110 drives the light string 200 by using the fixed driving voltage Vdd, the controller 160 continuously receives a warning result or signal. When the strength (voltage) of the luminance signal is less than the strength (the upper limit voltage Vmax) of the upper limit signal, the driving voltage Vdd has not reached a warning value, and the auxiliary comparator 156 outputs a low-level signal. In this case, the controller 160 performs no action. When the strength of the luminance signal is greater than the strength of the upper limit signal, the driving voltage Vdd is about to reach the warning value. The auxiliary comparator 156 outputs a high level signal to trigger the controller 160, and the controller 160 restarts voltage detection, controls the power converter 110 to gradually increase the driving voltage Vdd to the maximum value from the initial value, and receives the comparison result of the comparator 152, thereby detecting the value of the optimized driving voltage Vdd.

According to the foregoing driving circuit apparatus 100, when replacing or installing the light string 200, the user does not need to understand a difference between specifications of the light string 200, and may directly connect the light string 200 to the driving circuit apparatus 100. The driving circuit apparatus 100 may automatically detect the driving voltage Vdd that is required for driving the light string 200 to reach a maximum luminance but that does not burn out the light string 200, to continuously drive the light string 200 to emit light at the driving voltage Vdd. Moreover, in one or more embodiments of the present invention, the controller 160 may periodically, after being reset, or according to real-time detection, restart the program for detecting the driving voltage Vdd. An output value of the driving voltage Vdd changes in accordance with a change of an actual situation of the light string 200, to obtain an optimized driving voltage Vdd.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A driving circuit apparatus for automatically determining an optimized driving voltage of a light string, wherein the driving circuit apparatus is used to output a driving voltage to drive a light string to emit light, and automatically set a value of the driving voltage required to make a plurality of light sources of the light string reach a predetermined luminance, the driving circuit apparatus comprising:

a power converter, for outputting the driving voltage, wherein the driving voltage increases toward a maximum value from an initial value, and the driving voltage is stopped from increasing according to an interrupt signal to set the value of the driving voltage;

a reference light source, having one end electrically connectable to the light string;

a light shield defining an opaque chamber, wherein the reference light source is disposed in the chamber;

a luminance detector, disposed in the chamber, and configured to detect a luminance of a light emitted by the reference light source, and provide a luminance signal related to the luminance of the reference light source;

a comparison circuit, configured to receive the luminance signal, and determine whether a strength of the luminance signal is greater than a strength of a reference signal, and to output a comparison result; and a controller electrically connected to the power converter and the comparison circuit, and configured to send the interrupt signal to the power converter when a strength of the luminance signal is greater than a strength of the reference signal, and to cause the power converter to set the driving voltage to a value that causes the light sources of the light string to emit light having the predetermined luminance in response to the interrupt signal.

2. The driving circuit apparatus according to claim 1, wherein the reference light source is of a specification that is the same as that of each light source of the light string.

3. The driving circuit apparatus according to claim 1, wherein the reference light source is disposed at one end of the chamber, and the luminance detector is disposed at the other end of the chamber.

4. The driving circuit apparatus according to claim 1, wherein the controller is configured to send an initial signal to the power converter to start the power converter to begin to output the driving voltage, and to continuously increase the driving voltage toward the maximum value from the initial value.

5. The driving circuit apparatus according to claim 1, wherein the luminance detector is a photoresistor, and one end of the photoresistor receives a predetermined voltage while the other end of the photoresistor is electrically grounded through a grounding resistor, wherein a resistance value of the photoresistor decreases along with the luminance, and the luminance signal is a voltage of a node between the luminance detector and the grounding resistor while the reference signal is a reference voltage.

6. The driving circuit apparatus according to claim 5, wherein the comparison circuit comprises a comparator used for comparing the voltage of the luminance signal with the reference voltage, and is configured to output a high level signal when the voltage of the luminance signal is greater than the reference voltage, and to trigger the controller to send the interrupt signal.

7. The driving circuit apparatus according to claim 6, further comprising an auxiliary comparator connected to the comparator in parallel, wherein the auxiliary comparator is configured to receive the luminance signal, and determine whether the strength of the luminance signal is greater than a strength of an upper limit signal, to output a warning result; and when the strength of the luminance signal is greater than the strength of the upper limit signal, the controller again controls the power converter to increase the driving voltage toward the maximum value from the initial value and receives a comparison result of the comparator.

8. The driving circuit apparatus according to claim 1, further comprising a switch element, wherein the reference light source is configured to receive the driving voltage through the switch element, and the controller is configured to continuously output a switching signal, so that the switch element is rapidly switched between a switch-on position and a switch-off position.

9. The driving circuit apparatus according to claim 1, further comprising a memory unit, and wherein the controller is configured, each time the driving circuit apparatus is started, to check whether the memory unit stores the value of the driving voltage; and when a value is stored, the controller controls, by using the value of the driving voltage stored in the memory unit, the power converter to output the driving voltage by using the value, and ceases to detect the driving voltage; and when no value is stored, the controller controls the power converter to increase the driving voltage toward the maximum value from the initial value, and receives a comparison result of the comparison circuit.

10. The driving circuit apparatus according to claim 9, further comprising a reset switch, electrically connected to the controller, and configured to reset the memory unit, so that the controller controls the power converter to increase the driving voltage to the maximum value from the initial value, and receives the comparison result of the comparator.

11. A light string system for automatically detecting an optimized light-string driving voltage, comprising:

a light string comprising a plurality of light sources in electrical connection with one another, each of the light sources configured to output light having a light-element luminance;

a power circuit in electrical connection with the light string and configured to output a driving voltage to the light string, the power circuit configured to output the driving voltage within a range of an initial voltage to a maximum voltage, and to output an optimal driving voltage that is between the initial voltage and the maximum voltage;

a reference light source, electrically connected to the light string, including the plurality of light sources, and configured to output light of a luminance that is substantially the same as the luminance of the light-element luminance;

a light shield defining an opaque chamber, wherein the reference light source is disposed in the opaque chamber;

a luminance detector disposed in the chamber, and configured to output a luminance signal based upon the luminance of the light emitted by the reference light source;

a controller electrically connected to the power circuit, and configured to cause the power circuit to output a driving voltage that is set to the initial voltage, then to increase the driving voltage until the driving voltage reaches the optimal driving voltage as determined by a comparison of the luminance signal and a reference value.

12. The light string system of claim 11, wherein the controller is further configured to output an interrupt signal to the power circuit, the interrupt signal causing the power circuit to stop increasing the driving voltage and to hold the driving voltage at the optimal driving voltage.

13. The light string system of claim 12, further comprising a comparison circuit in communication with the controller, and configured to receive the luminance signal, and determine whether a strength of the luminance signal is greater than a strength of the reference value, and to output a comparison result to the controller, and wherein the controller sends the interrupt signal based on the comparison result.

14. The driving circuit apparatus according to claim 13, wherein the comparison circuit comprises a comparator used for comparing a voltage corresponding to the luminance signal with another voltage corresponding to the reference value, and is configured to output a high-level signal when the voltage of the luminance signal is greater than the reference voltage, and to trigger the controller to send the interrupt signal.

15. The driving circuit apparatus according to claim 14, further comprising an auxiliary comparator connected to the comparator in parallel, wherein the auxiliary comparator is configured to receive the luminance signal, and to determine whether a strength of the luminance signal is greater than a strength of an upper limit signal, to output a warning result; and when the strength of the luminance signal is greater than the strength of the upper limit signal, the controller again controls the power circuit to increase the driving voltage toward the maximum value from the initial value and receives a comparison result of the comparator.

16. The light string system of claim 11, wherein the controller is configured to send an initial signal to the power circuit to start the power circuit to begin to output the driving voltage, and to continuously increase the driving voltage toward the maximum value from the initial value.

17. The light string system of claim 11, wherein the luminance detector is a photoresistor, and one end of the photoresistor receives a predetermined voltage while the other end of the photoresistor is electrically grounded through a grounding resistor, wherein a resistance value of the photoresistor decreases along with detected luminance, and the luminance signal is a voltage of a node between the luminance detection element and the grounding resistor and the reference value is a reference voltage.

18. The driving circuit apparatus according to claim 11, further comprising a switch element, wherein the reference light source is configured to receive the driving voltage through the switch element, and the controller is configured to continuously output a switching signal, so that the switch element is rapidly switched between a switch-on position and a switch-off position.

19. The driving circuit apparatus according to claim 11, further comprising a memory unit, and wherein the controller is configured, each time the driving circuit apparatus is started, to check whether the memory unit stores the value of the driving voltage; and when a value is stored, the controller controls, by using the value of the driving voltage stored in the memory unit, the power converter to output the driving voltage by using the value, and ceases to detect the driving voltage; and when no value is stored, the controller controls the power converter to increase the driving voltage toward the maximum value from the initial value, and receives a comparison result of the comparator.

20. The light string system of claim 11, wherein the plurality of light elements comprises a first group of light elements electrically connect to each other in parallel and a second group of light elements electrically connected to each other in series, the first and second groups of light elements electrically connected in parallel.

21. The driving circuit apparatus according to claim 1, wherein the light string includes another end that is electrically grounded.

22. The driving circuit apparatus according to claim 21, wherein the other end is electrically grounded through a transistor.

* * * * *